US012564232B2

(12) United States Patent
Mitchell

(10) Patent No.: US 12,564,232 B2
(45) Date of Patent: Mar. 3, 2026

(54) OIL-TREATED, SILK-LINED HAIR WEFT AND OTHER HAIR ACCESSORIES

(71) Applicant: Sandra Gail Mitchell, Florence, SC (US)

(72) Inventor: Sandra Gail Mitchell, Florence, SC (US)

( * ) Notice: Subject to any disclaimer, the term of this patent is extended or adjusted under 35 U.S.C. 154(b) by 579 days.

(21) Appl. No.: 17/565,431

(22) Filed: Dec. 29, 2021

(65) Prior Publication Data

US 2022/0202122 A1 Jun. 30, 2022

Related U.S. Application Data

(60) Provisional application No. 63/131,753, filed on Dec. 29, 2020.

(51) Int. Cl.
*A41G 5/00* (2006.01)

(52) U.S. Cl.
CPC ..... *A41G 5/0046* (2013.01)

(58) Field of Classification Search
CPC ..... A41G 5/00; A41G 5/0013; A41G 5/004; A41G 5/0053; A41G 5/006; A41G 5/008; A41G 5/0086; A41G 5/0093
See application file for complete search history.

(56) References Cited

U.S. PATENT DOCUMENTS 210,489 A * 12/1878 Bracher
8,739,803 B2 * 6/2014 Freelove ..... A41G 5/0046 132/201
2013/0133680 A1 * 5/2013 Wang ..... A41G 5/008 132/54

* cited by examiner

*Primary Examiner* — Rachel R Steitz
(74) *Attorney, Agent, or Firm* — Charlena Thorpe, Esq.; Incorporating Innovation LLC

(57) ABSTRACT

Implementations of an oil-treated silk-lined hair weft and other hair accessories comprise an oil-treated silken material configured to attach to a hair extension weft or other hair related accessories, an oil-treated silk-lined hair extension weft, and other variations and accessories formed thereof. In some implementations, a method of using the oil-treated silk-lined hair weft and other hair accessories comprises attaching the oil-treated silken material to a hair extension weft and may further comprise attaching the oil-treated silk-lined hair weft to a wearer's head.

16 Claims, 4 Drawing Sheets

OIL-TREATED, SILK-LINED HAIR WEFT AND OTHER HAIR ACCESSORIES

CROSS REFERENCE TO RELATED APPLICATION

This application claims the benefit of U.S. Patent Application Ser. No. 63/131,753, which was filed on Dec. 29, 2020, and is incorporated herein by reference in its entirety.

TECHNICAL FIELD

This disclosure relates to implementations of an oil-treated, silk-lined hair weft and other hair accessories.

BACKGROUND

FIGS. 1A and 1B illustrate example hair extensions, which are sometimes referred to as hair wefts or tracks. As shown in FIGS. 1A and 1B, hair extensions are a plurality of strings of hair sewn together on one end to form an elongated strip or weft of hair. The elongated weft of hair extends horizontally in a first direction and the strings of hair extends from the weft and hang vertically in a second direction that is perpendicular to the first direction.

As shown in FIGS. 2A-2C, hair extensions are attached to a wearer's hair by the weft portion or weft of the hair extensions. As shown in FIG. 2A, the weft portion of the hair extensions may be attached to a wearer's hair with an appropriate glue or adhesive. As shown in FIGS. 2B and 2C, the weft of the hair extensions may be attached to a wearer's hair by being sewn to a cornrow or braid made with the wearer's natural hair.

However, the weft of hair extensions that are attached to a wearer's hair may come into contact with the wearer's scalp and cause the scalp to itch. Furthermore, the weft may cause the wearer's natural hair that the weft comes in contact with to become dry causing the hair to break.

DETAILED DESCRIPTION

Implementations of an oil-treated, silk-lined hair weft and other hair accessories are provided. In some implementations, the oil-treated, silk-lined hair weft and other hair accessories comprises an oil-treated silken material configured to attach to the weft (or weft portion) of a hair extension. In some implementations, the oil-treated, silk-lined hair weft and other hair accessories comprises a hair extension with the oil-treated silken material attached to the weft of the hair extension.

In some implementations, the oil-treated, silk-lined hair weft and other hair accessories may further comprise a bonnet, a hair band, or any other suitable hair accessories that includes a silken and/or oil-treated material. In some implementations, the oil-treated, silk-lined hair weft and other hair accessories may further comprise an oil spray. In some implementations, the oil-treated, silk-lined hair weft and other hair accessories may further comprise any other suitable oil-treated, silk-lined hair accessories.

In some implementations, the oil of the oil-treated, silk-lined hair weft and other hair accessories comprises one or more types of oil. In some implementations, the one or more oils are organic.

In some implementations, the oil-treated, silk-lined hair weft is configured to come into contact with a wearer's head (e.g., scalp and/or hair) instead of the weft of a hair extension when the oil-treated, silk-lined hair weft is used. In some implementations, the oil-treated, silk-lined hair weft thereby prevents the weft from causing the wearer's scalp to itch and/or the wearer's hair to become dry and break.

In some implementations, the oil-treated, silk-lined hair accessories are configured to come into contact with a wearer's scalp and/or hair instead of the accessories directly when the oil-treated, silk-lined hair accessories are used. In some implementations, the oil-treated, silk-lined hair accessories thereby prevent the accessories from causing the wearer's scalp to itch and/or the wearer's hair to become dry and break.

In some implementations, a method of using the oil-treated, silk-lined hair weft comprises attaching a hair extension that includes the oil-treated, silk-lined hair weft to a wearer's head by the oil-treated, silk-lined hair weft.

In some implementations, a method of using the oil-treated, silk-lined hair accessories comprises wearing the oil-treated, silk-lined hair accessories accordingly.

Figure 1A:
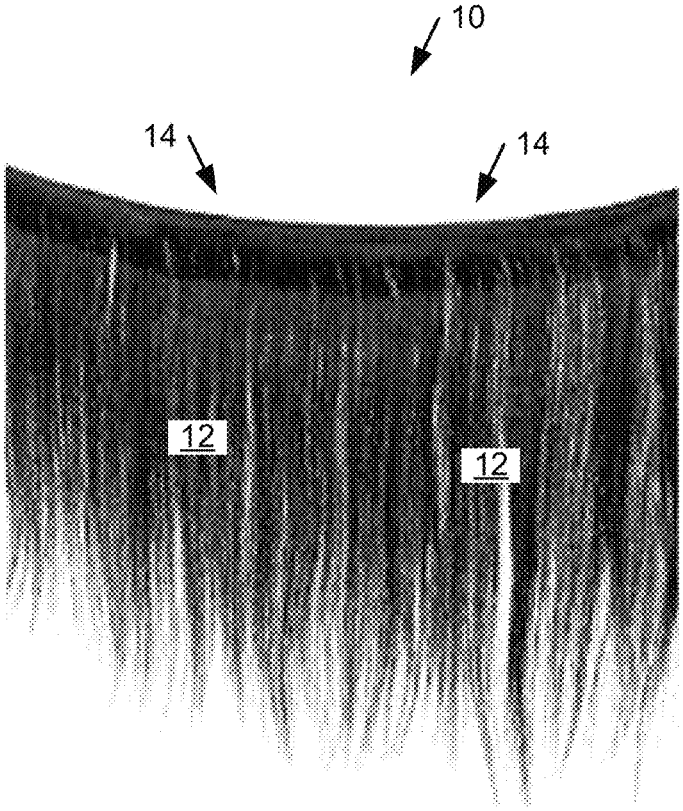
FIG. 1A (PRIOR ART)
FIGS. 1A and 1B illustrate example hair extensions.
Figure 1B:
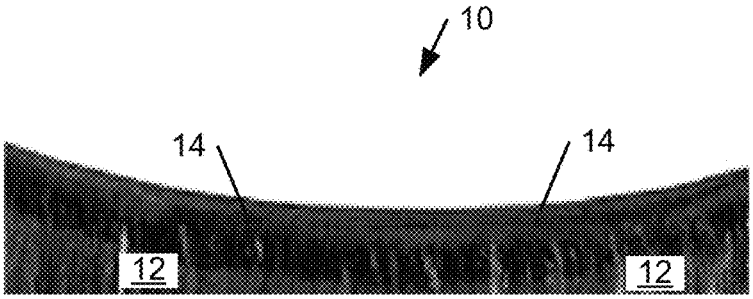
FIG. 1B (PRIOR ART)

FIGS. 1A and 1B illustrate example hair extensions 10, which are sometimes referred to as hair wefts or tracks. As shown in FIGS. 1A and 1B, hair extensions 10 are a plurality of strings of hair 12 sewn together on one end to form an elongated strip or weft 14 of hair 12. The elongated weft 14 of hair 12 extends horizontally in a first direction and the strings of hair 12 extends from the weft 14 and hang vertically in a second direction that is perpendicular to the first direction.

Figure 2A:
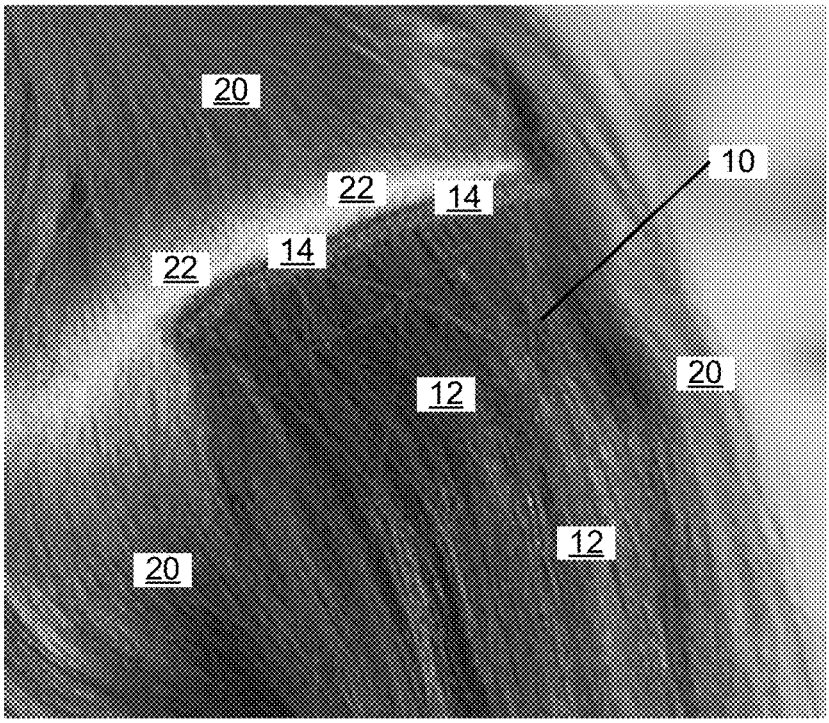
FIG. 2A (PRIOR ART)
FIGS. 2A-2C illustrate example hair extensions attached to a wearer's hair.
Figure 2B:
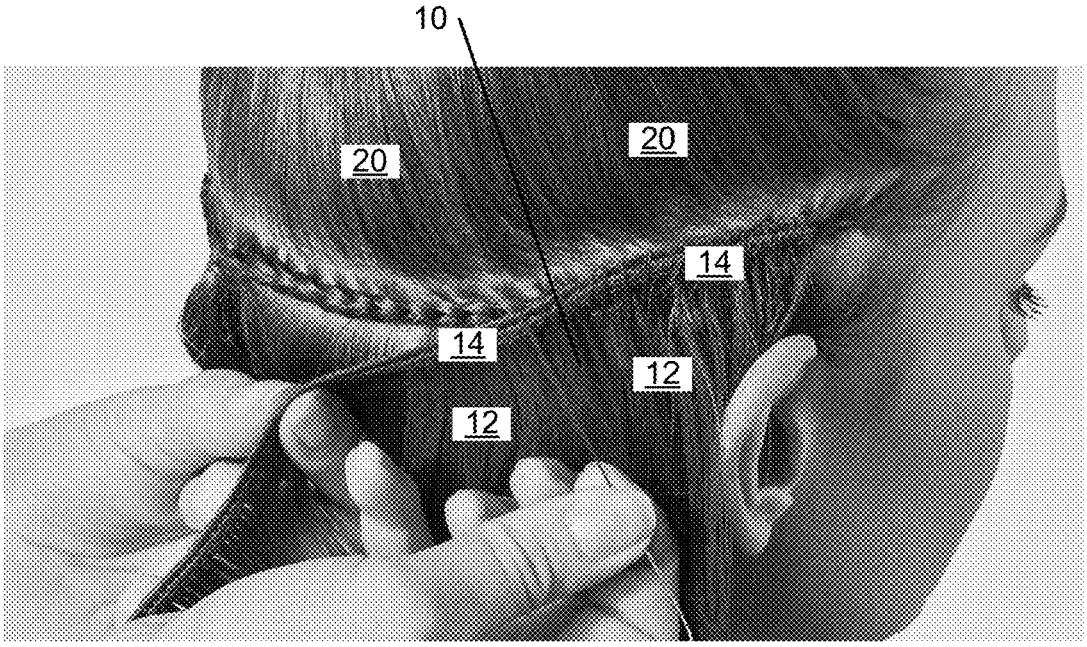
FIG. 2B (PRIOR ART)
Figure 2C:
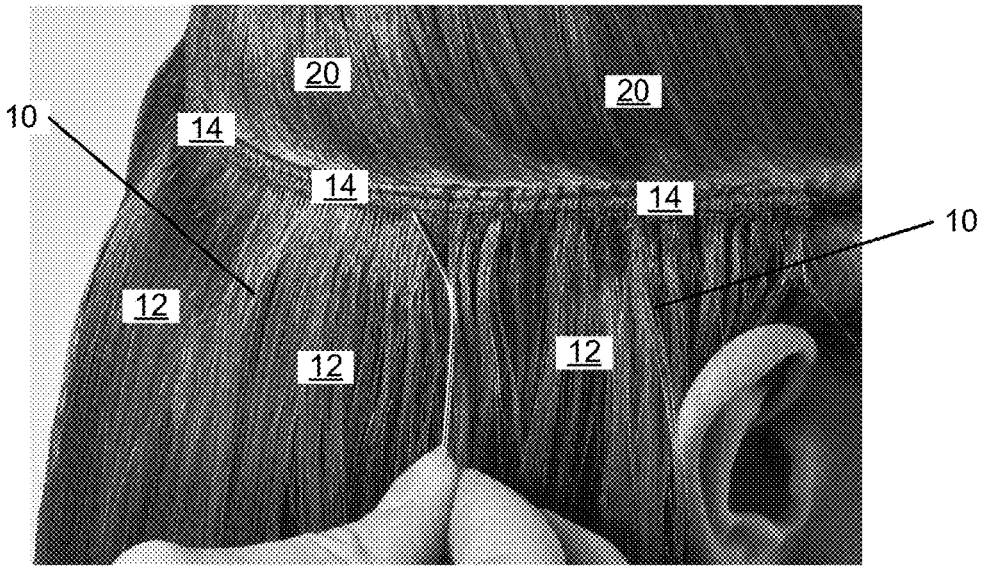
FIG. 2C (PRIOR ART)

As shown in FIGS. 2A-2C, hair extensions 10 are attached to a wearer's hair 20 by the weft portion or weft 14 of the hair extensions 10. As shown in FIG. 2A, the weft portion 14 of the hair extensions 10 may be attached to a wearer's hair 20 with an appropriate glue or adhesive. As shown in FIGS. 2B and 2C, the weft 14 of the hair extensions 10 may be attached to a wearer's hair 20 by being sewn to a cornrow or braid made with the wearer's natural hair 20.

However, the weft 14 of hair extensions 10 that are attached to a wearer's hair 20 may come into contact with the wearer's scalp 22 and cause the scalp 22 to itch. Furthermore, the weft 14 may cause the wearer's natural hair 20 that the weft 14 comes in contact with to become dry causing the hair 20 to break.

Figure 3A:
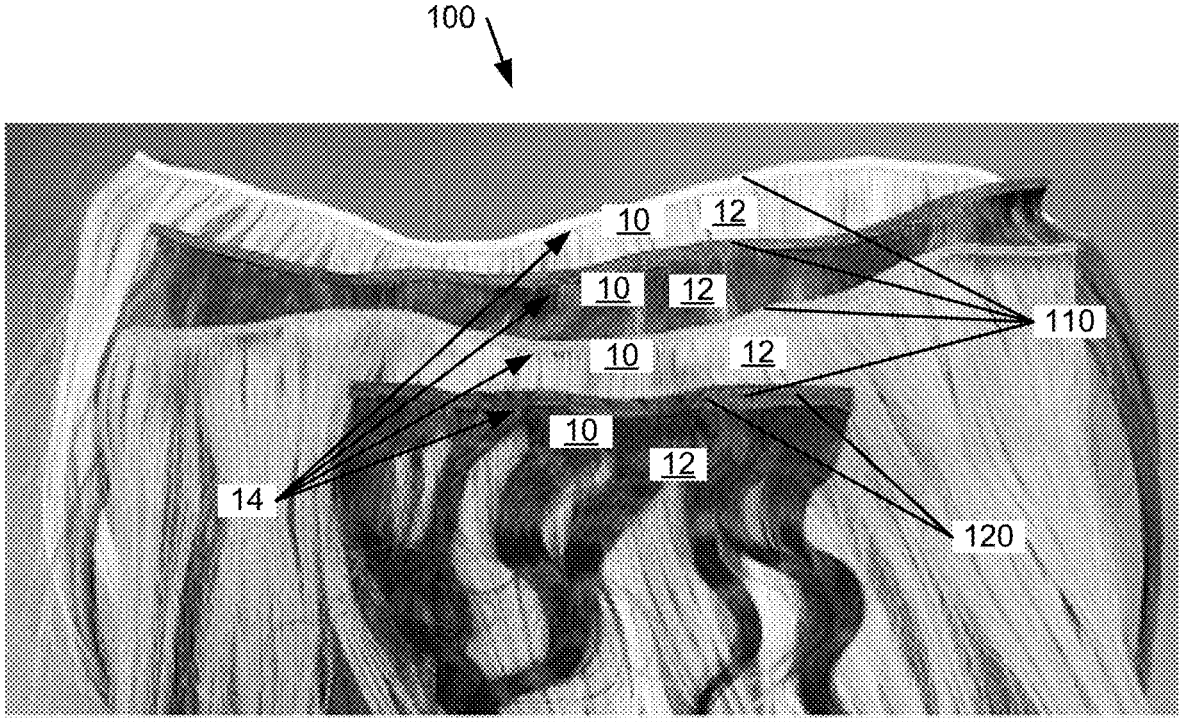
FIGS. 3A and 3B illustrate implementations of an example oil-treated, silk-lined hair weft according to the present disclosure.
Figure 3B:
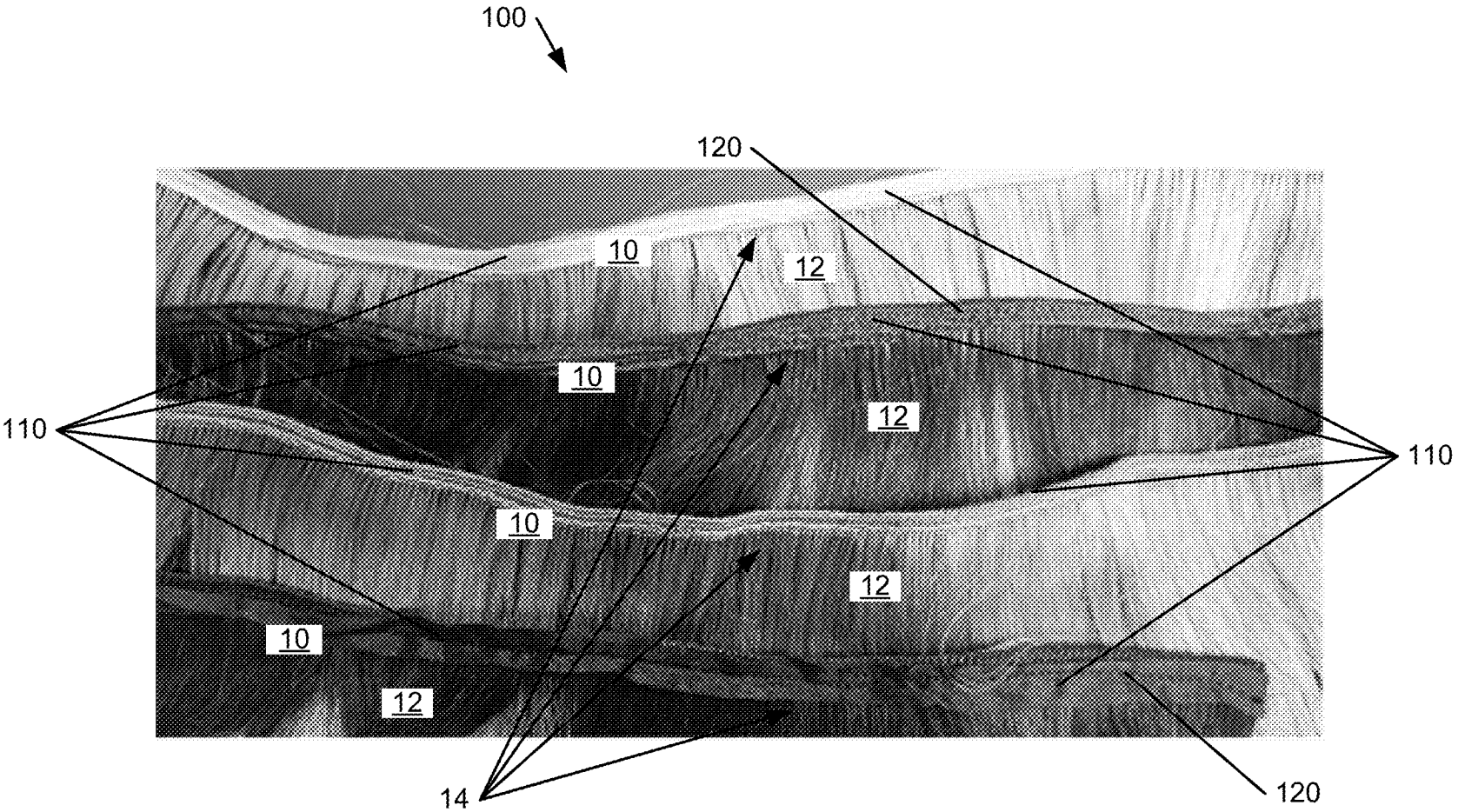

FIGS. 3A and 3B illustrate implementations of an example oil-treated, silk-lined hair weft 100 according to the present disclosure. As shown in FIGS. 3A and 3B, in some implementations, the oil-treated, silk-lined hair weft 100 comprises an oil-treated silken material 110 configured to attach to a hair extension weft (or weft portion) 14. In some implementations, the oil-treated, silk-lined hair weft 100 comprises a hair extension 10 with the oil-treated silken material 110 attached to the weft 14 of the hair extension 10.

In some implementations, the oil-treated, silk-lined hair weft 100 may further comprise one or more oil-treated silken threads 120 configured to attach the material 110 of the oil-treated, silk-lined hair weft 100 to the weft 14 of a hair extension 10. In some implementations, the oil-treated, silk-lined hair weft 100 may further comprise any other suitable features or components.

In some implementations, as described below, the oil-treated, silk-lined hair accessories may comprise a bonnet, a hair band, or any other suitable hair accessories.

In some implementations, the oil-treated, silk-lined hair weft 100 and/or the oil-treated, silk-lined hair accessories may further comprise an oil spray.

In some implementations, as described below, the oil of the oil-treated, silk-lined hair weft 100 and other hair accessories may comprise one or more types of oil. In some implementations, the one or more oils are organic.

In some implementations, the material 110 of the oil-treated, silk-lined hair weft 100 is silken. For example, in some implementations, the material 110 is silk or a silk-like material, such as satin.

In some implementations, the material 110 of the oil-treated, silk-lined hair weft 100 is oil-treated. For example, in some implementations, the material 110 is treated, as described below, with one or more oils, also described below.

In some implementations, the material 110 of the oil-treated, silk-lined hair weft 100 may be any suitable configuration of material. For example, in some implementations, the material 110 may be a silken ribbon-like material. In some implementations, the material 110 may comprise two or more pieces of material.

In some implementations, the material 110 of the oil-treated, silk-lined hair weft 100 may be any suitable size and shape. For example, in some implementations, the material 110 may be any suitable size and shape such that the material 110 can attach over a suitable portion of a weft 14 of a hair extension 10. In some implementations, such suitable portion of a weft 14 may be the inner and/or outer side of the weft 14, such as described below.

In some implementations, the material 110 of the oil-treated, silk-lined hair weft 100 may be any suitable color. For example, as shown in FIGS. 3A and 3B, in some implementations, the material 110 may be the same or similar color (e.g., matches the color) as the color of the hair 12 of the hair extension 10.

In some implementations, the material 110 of the oil-treated, silk-lined hair weft 100 is attached to the weft 14 of a hair extension 10 such that the weft 14 will not come into contact with a wearer's head (e.g., scalp 22 and/or hair 20) when the oil-treated, silk-lined hair weft 100 is used. In this way, in some implementations, the silken material 110 comes into contact with the wearer's scalp 22 and/or hair 20 instead of the weft 14 when the oil-treated, silk-lined hair weft 100 is used and thereby prevents the weft 14 from causing the wearer's scalp 22 to itch and/or the wearer's hair 20 to become dry and break.

In some implementations, the material 110 of the oil-treated, silk-lined hair weft 100 may be attached to the weft 14 of a hair extension 10 in any suitable configuration. For example, in some implementations, the material 110 may be attached such that the inner side of the weft 14 is silk-lined. In some implementations, the material 110 may be attached such that the inner side and the outer side of the weft 14 is silk-lined.

In some implementations, the inner side of the weft 14 may be the portion of the weft 14 that faces toward and/or positions adjacent to a wearer's scalp 22 and/or hair 20 when the oil-treated, silk-lined hair weft 100 is used. In some implementations, the outer side of the weft 14 may be the portion of the weft 14 that is opposite to and/or other than the inner side of the weft 14.

In some implementations, the material 110 of the oil-treated, silk-lined hair weft 100 may be attached to the weft 14 of a hair extension 10 by any suitable way. For example, as introduced above, in some implementations, the oil-treated, silk-lined hair weft 100 may further comprise one or more threads 120 that attach the material 110 to the weft 14 of a hair extension 10.

In some implementations, the thread 120 of the oil-treated, silk-lined hair weft 100 may be a silken thread. For example, in some implementations, the thread 120 may be silk or a silk-like material, such as satin.

In some implementations, the thread 120 may be any other suitable material.

In some implementations, the thread 120 of the oil-treated, silk-lined hair weft 100 may be oil-treated the same or similar to the material 110 of the oil-treated, silk-lined hair weft 100. For example, in some implementations, the thread 120 may be treated, as described below, with one or more oils, also described below.

In some implementations, the thread 120 of the oil-treated, silk-lined hair weft 100 may be any suitable length or other suitable dimension. For example, in some implementations, the thread 120 may be any suitable length such that the thread 120 can attach the material 110 of the oil-treated, silk-lined hair weft 100 to a weft 14 of a hair extension 10.

In some implementations, the thread 120 of the oil-treated, silk-lined hair weft 100 may be any suitable color. For example, in some implementations, the thread 120 may be the same or similar color (e.g., matches the color) as the weft 14 and/or the hair 12 of the hair extension 10.

In some implementations, the thread 120 may attach the material 110 of the oil-treated, silk-lined hair weft 100 to the weft 14 of a hair extension 10 in any suitable way. For example, in some implementations, the thread 120 may wrap around the material 110 to attach the material 110 to the weft 14 of a hair extension 10.

In some implementations, the thread 120 may attach the material 110 of the oil-treated, silk-lined hair weft 100 to the weft 14 of a hair extension 10 in a configuration such that the thread 120 is hidden. For example, in some implementations, the thread 120 may attach the material 110 in a configuration such that the thread 120 cannot be seen when the oil-treated, silk-lined hair weft 100 is used.

In some implementations, the thread 120 of the oil-treated, silk-lined hair weft 100 may be positioned, e.g. sewn or woven, in any other suitable configuration to attach the material 110 to the weft 14 of a hair extension 10.

As introduced above, in some implementations, the material 110 of the oil-treated, silk-lined hair weft 100 is treated with one or more oils ("oil"). In some implementations, the treatment with the oil makes the material 110 of the oil-treated, silk-lined hair weft 100 very soft (e.g., even softer).

In some implementations, the oil of the oil-treated, silk-lined hair weft 100 comprises one or more types of oil. For example, in some implementations, the oil comprises one or more of argon oil, olive oil, caster oil, peppermint oil, lavender oil, and/or shea butter oil.

In some implementations, the oil comprises a combination that includes argon oil, olive oil, caster oil, and either peppermint oil or lavender oil. For example, in some implementations, the oil comprises argon oil, caster oil, shea butter oil, and peppermint oil.

In some implementations, the oil comprises argon oil, caster oil, shea butter oil, and rosemary oil.

In some implementations, the oil may comprise any other suitable oil or combination of oils that makes the material 110 of the oil-treated, silk-lined hair weft 100 very soft when treated with the oil. In some implementations, the oil may further comprise any other suitable substance or combination of substances.

In some implementations, one or more of the above described oils are organic. In some implementations, one or more of the above described oils may have any other suitable features.

As introduced above, in some implementations, the thread 120 of the oil-treated, silk-lined hair weft 100 may also be treated with the oil, such as to also make the thread 120 very soft (e.g., even softer).

As introduced above, in some implementations, the oil-treated, silk-lined hair weft 100 and/or the oil-treated, silk-lined hair accessories (described more below) may further comprise an oil spray. In some implementations, the oil spray comprises the above described oil in a spray-able configuration.

In some implementations, the oil spray can be applied to the oil-treated, silk-lined hair weft 100 and/or the oil-treated, silk-lined hair accessories for further oil application and/or treatment.

In some implementations, the material 110 of the oil-treated, silk-lined hair weft 100 is treated with the above described oil in one or more ways. For example, in some implementations, the material 110 is treated by dipping the material 110 in the oil or otherwise applying the oil to the material 110.

In some implementations, the material 110 is treated by air drying or otherwise drying the material 110 after applying the oil to the material 110. In some implementations, the material 110 is treated by ironing or otherwise pressing the material after the material 110 is dried.

In some implementations, the material 110 may be treated with the oil in any other suitable way.

In some implementations, the thread 120 of the oil-treated, silk-lined hair weft 100 is treated with the oil in the same or similar way as described above for the material 110.

In some implementations, the oil-treated, silk-lined hair weft 100 is configured to come into contact with a wearer's head (e.g., scalp 22 and/or hair 20) instead of the weft 14 of a hair extension 10 when the oil-treated, silk-lined hair weft 100 is used. In some implementations, the oil-treated, silk-lined hair weft 100 thereby prevents the weft 14 from causing the wearer's scalp 22 to itch and/or the wearer's hair 20 to become dry and break.

As introduced above, in some implementations, the oil-treated, silk-lined hair accessories may comprise a bonnet, a hair band, or any other suitable hair accessories. In some implementations, the oil-treated, silk-lined hair accessories are configured similar to the oil-treated, silk-lined hair weft 100.

For example, in some implementations, the oil-treated, silk-lined hair accessories comprise a silken material that is the same or similar to the material 110 of the oil-treated, silk-lined hair weft 100. In some implementations, the silken material is treated with the above described oil the same or similar to the material 110 of the oil-treated, silk-lined hair weft 100.

In some implementations, the oil-treated silken material is attached to the oil-treated, silk-lined hair accessories such that the material comes into contact with a wearer's scalp 22 and/or hair 20 instead of the accessories directly when the oil-treated, silk-lined hair accessories are used. In some implementations, the oil-treated silken material may be attached to the oil-treated, silk-lined hair accessories with an oil-treated silken thread that is the same or similar to the thread 120 of the oil-treated, silk-lined hair weft 100.

In this way, in some implementations, the oil-treated, silk-lined hair accessories do not cause the wearer's scalp 22 to itch and/or the wearer's hair 20 to become dry and break when the oil-treated, silk-lined hair accessories are used.

In some implementations, the oil-treated, silk-lined hair accessories are configured to come into contact with a wearer's scalp 22 and/or hair 20 instead of the accessories directly when the oil-treated, silk-lined hair accessories are used. In some implementations, the oil-treated, silk-lined hair accessories thereby prevent the accessories from causing the wearer's scalp 22 to itch and/or the wearer's hair 20 to become dry and break.

In some implementations, the oil-treated, silk-lined hair weft 100 and the oil-treated, silk-lined hair accessories comprise any suitable dimensions, such as described above.

In some implementations, the oil-treated, silk-lined hair weft 100 and the oil-treated, silk-lined hair accessories are composed of any suitable materials, such as described above.

In some implementations, the oil-treated, silk-lined hair weft 100 and the oil-treated, silk-lined hair accessories can have any suitable appearance, such as described above and shown in the figures.

In some implementations, an example method of using the oil-treated, silk-lined hair weft 100, with respect to the above-described figures, comprises attaching a hair extension 10 that includes the oil-treated, silk-lined hair weft 100 to a wearer's head by the oil-treated, silk-lined hair weft 100. In some implementations, the oil-treated, silk-lined hair weft 100 is attached such that the oil-treated silken material 110 of the oil-treated, silk-lined hair weft 100 comes into contact with the wearer's head (e.g., scalp 22 and/or hair 20) instead of the weft 14 of the hair extension.

In some implementations, the method may further comprise using the above described oil spray with the oil-treated, silk-lined hair weft 100.

In some implementations, an example method of using the oil-treated, silk-lined hair accessories comprises wearing the oil-treated, silk-lined hair accessories such that the oil-treated silken material of the oil-treated, silk-lined hair accessories comes into contact with the wearer's scalp 22 and/or hair 20 instead of the accessories directly.

In some implementations, the method may further comprise using the above described oil spray with the oil-treated, silk-lined hair accessories.

The figures, including photographs and drawings, comprised herewith may represent one or more implementations of the oil-treated, silk-lined hair weft and other hair accessories.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A hair extension system comprising:

an oil-treated silken material wherein the oil-treated silken material is an elongated piece of material and a hair extension comprising a plurality of strings of hair sewn together on a first end thereby forming an elongated weft wherein the hair extension has an outer-side and an inner-side, wherein the elongated weft extends horizontally in a first direction and the strings of hair extends from the weft and hang vertically in a second direction that is perpendicular to the first direction, and wherein:

the oil-treated silken material is attached to the inner-side extension on top of along the weft of the hair extension such that the oil-treated silken material is the outermost surface of the hair extension system along the weft on the first end of the hair extension; and the oil-treated silken material comprises a silken material that is sized and shaped to attach to and cover the weft and the silken material is treated with one or more oils such that the silken material is softened by the treatment.

2. The hair extension system of claim 1 wherein the silken material of the oil-treated silken material comprises an oil-dipped, air dried, ironed silken material.

3. The hair extension system of claim 1 wherein the oil-treated silken material comprises an elongated ribbon-shaped piece of material.

4. The hair extension system of claim 1 wherein the inner side of the hair extension faces toward the head of a wearer when the hair extension is attached to the head of the wearer.

5. The hair extension system of claim 1 wherein the one or more oils comprises at least one of argon oil, olive oil, caster oil, peppermint oil, lavender oil, or shea butter oil.

6. The hair extension system of claim 1 wherein the one or more oils comprises argon oil, olive oil, caster oil, and one of peppermint oil or lavender oil.

7. The hair extension system of claim 1 wherein the one or more oils comprises argon oil, caster oil, shea butter oil, and rosemary oil.

8. The hair extension system of claim 1 wherein the one or more oils comprises an organic oil.

9. The hair extension system of claim 1 wherein the silken material of the oil-treated silken material comprises a silk material.

10. The hair extension system of claim 1 wherein the silken material of the oil-treated silken material comprises a satin material.

11. The hair extension system of claim 1 further comprising a silken thread sized and shaped to attach the oil-treated silken material to the weft of the hair extension wherein the oil-treated silken material is attached to the weft of the hair extension with the silken thread.

12. The hair extension system of claim 11 wherein the silken thread is treated with one or more oils such that the silken thread is softened by the treatment.

13. A method of making the article of manufacture of claim 1 comprising treating the silken material of the oil-treated silken material with the one or more oils by:

dipping the silken material in the one or more oils;

air drying the silken material; and ironing the silken material.

14. A method comprising;

obtaining a silken material and treating the silken material with one or more oils by dipping the silken material in the one or more oils, air drying the silken material, and ironing the silken material;

obtaining a silken thread and treating the silken material with one or more oils;

sizing and shaping the silken material into an elongated ribbon-shaped piece of material to attach to a weft of a hair extension such that when the hair extension is attached to the head of a wearer the oil-treated silken material contacts the head of the wearer such that the weft of the hair extension does not contact the head of the wearer;

attaching the oil-treated silken material to an inner side of a weft of a hair extension using the oil-treated silken thread wherein the weft is an elongated portion of the hair extension along which a plurality of strings of hair of the hair extension are attached together on a side of the hair extension such that the strings of hair extend from the weft when the hair extension is attached to the head of the wearer; and attaching the hair extension to the head of a wearer wherein the inner side of the weft faces toward the head of a wearer when the hair extension is attached to the head of the wearer such that the oil-treated silken material contacts the head of the wearer and the weft of the hair extension does not contact the head of the wearer.

15. The method of claim 14 wherein the one or more oils comprises an organic oil.

16. The method of claim 14 further comprising spraying oil on the oil-treated silken material after the oil-treated silken material is attached to the weft.

* * * * *